US005345648A

United States Patent [19]

Graves

[11] Patent Number: 5,345,648

[45] Date of Patent: Sep. 13, 1994

[54] PAINT ROLLER FRAME AND CAGE ASSEMBLY

[75] Inventor: Howard Graves, Berlin, Ohio

[73] Assignee: The Wooster Brush Company, Wooster, Ohio

[21] Appl. No.: 86,192

[22] Filed: Jun. 30, 1993

Related U.S. Application Data

[63] Continuation of Ser. No. 800,430, Nov. 29, 1991, abandoned.

[51] Int. Cl.[5] ..... B05C 17/02

[52] U.S. Cl. ..... 15/230.11; 492/19

[58] Field of Search ..... 15/230.11; 492/16, 17, 492/19, 18, 20

[56] References Cited

U.S. PATENT DOCUMENTS

| | | | |
|---|---|---|---|
| 2,520,863 | 8/1950 | Thomas et al. . | |
| 2,669,743 | 2/1954 | Coughlan | 29/116.1 |
| 2,675,605 | 4/1954 | Thomas | 15/230.11 |
| 2,970,366 | 2/1961 | Gill | 15/230.11 |
| 2,982,010 | 5/1961 | Johns . | |
| 3,447,184 | 6/1969 | McGinley | 15/230.11 |
| 3,745,624 | 7/1973 | Newmann | 15/230.11 |
| 3,751,748 | 8/1973 | Roe et al. | 29/117 |
| 3,877,123 | 4/1975 | Pharris | 15/230.11 |
| 3,986,226 | 10/1976 | Roe et al. | 492/32 |
| 4,209,883 | 7/1980 | Hawk | 15/230.11 |
| 4,361,923 | 12/1982 | McKay | 15/230.11 |
| 4,402,102 | 9/1983 | Al-samman | 15/230.11 |
| 4,937,909 | 7/1990 | Georgiou | 15/230.11 |
| 5,210,899 | 5/1993 | Goldstein et al. | 15/230.11 |

FOREIGN PATENT DOCUMENTS

| | | | |
|---|---|---|---|
| 0922693 | 7/1949 | Fed. Rep. of Germany | 15/230.11 |
| 2119004 | 10/1972 | Fed. Rep. of Germany | 15/230.11 |
| 1107072 | 12/1955 | France | 15/230.11 |

*Primary Examiner*—David A. Scherbel
*Assistant Examiner*—Tony G. Soohoo
*Attorney, Agent, or Firm*—Renner, Otto, Boisselle & Sklar

[57] ABSTRACT

A paint roller frame and cage assembly mounted for rotation on a shaft portion of the roller frame. The cage assembly includes a plurality of circumferentially spaced, axially extending support bars joined together by a plurality of ribs providing an annular support for uniformly supporting a roller cover thereon. At the inboard end of the support bars is an annular flange having an outer diameter less than the outer diameter of the annular support. Mounted on the annular flange is a retaining spring including a Belleville type spring washer having circumferentially spaced apart spring fingers extending radially and axially outwardly from the outer periphery of the washer for frictionally retaining the roller cover on the cage assembly. The Belleville type spring washer is retained on the annular flange by an end cap having a first annular sleeve telescopingly received over the annular flange. A radial shoulder on the end cap acts as a stop for locating the roller cover on the cage assembly when the roller cover is fully inserted thereon. The end cap also includes a second annular sleeve radially outwardly spaced from the first sleeve having an outer diameter substantially corresponding to the outer diameter of the annular support to provide a continuation of the annular support for supporting the roller cover up against the radial shoulder on the end cap, but with a clearance space between the end of the second annular sleeve and adjacent ends of the support bars for receipt of the retaining spring fingers therein.

25 Claims, 2 Drawing Sheets

PAINT ROLLER FRAME AND CAGE ASSEMBLY

This is a continuation of copending application Ser. No. 07/800,430 filed on Nov. 29, 1991, now abandoned.

FIELD OF THE INVENTION

The present invention relates generally to a paint roller frame and cage assembly which securely fastens a roller cover to the frame while painting and still allows the roller cover to be quickly and easily removed therefrom for ease of cleaning of the cage assembly and replacement of the roller cover after use.

BACKGROUND OF THE INVENTION

There are many different types of paint roller frames and cage assemblies that permit the removal and replacement of paint roller covers with varying degrees of difficulty. However, one of the major drawbacks of most paint roller frames and cage assemblies of this type is that if the roller cover is relatively easy to insert and remove, it is usually not as positively and securely retained in place during use as one would like, and vice versa. Another drawback is that some cage assemblies used to support the paint roller cover during painting include substantial areas where paint may become entrapped, making such cage assemblies difficult to clean. Also, most cage assemblies of this type do not provide uniform full-span support of the roller cover, whereby the roller cover may develop flat spots or become out of round, making it much less effective in spreading paint.

SUMMARY OF THE INVENTION

The present invention provides a paint roller frame and cage assembly that allows for the easy assembly and removal of a roller cover from the cage assembly and yet positively and securely retains the roller cover in place on the cage assembly during use.

In accordance with one aspect of the invention, a retaining spring located adjacent the inboard end of the cage assembly is used to securely fasten the roller cover to the cage assembly while painting and still allow the roller cover to be quickly and easily removed after use for ease of cleaning and/or replacement.

In accordance with another aspect of the invention, the retaining spring includes a Belleville type spring washer portion and a plurality of circumferentially 10 spaced apart spring fingers extending radially and axially outwardly from the outer periphery of the washer portion. The deflection of the Belleville type spring washer portion permits the finger length to be relatively short to minimize possible areas of entrapment of paint both under the fingers and inside the associated supporting structure and still achieve the necessary overall deflection of the fingers to retain the normal range of tolerances of roller covers on the cage assembly.

In accordance with yet another aspect of the invention, the cage assembly provides uniform support of the roller cover throughout substantially its entire length, preventing the roller cover from developing flat spots or becoming out of round during use.

Further in accordance with this invention, the cage assembly is relatively lightweight for reduced fatigue.

In accordance with another aspect of the invention, the cage assembly is easy to clean when the roller cover is removed therefrom.

These and other objects, advantages, features and aspects of the present invention will become apparent as the following description proceeds.

To the accomplishment of the foregoing and related ends, the invention, then, comprises the features hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
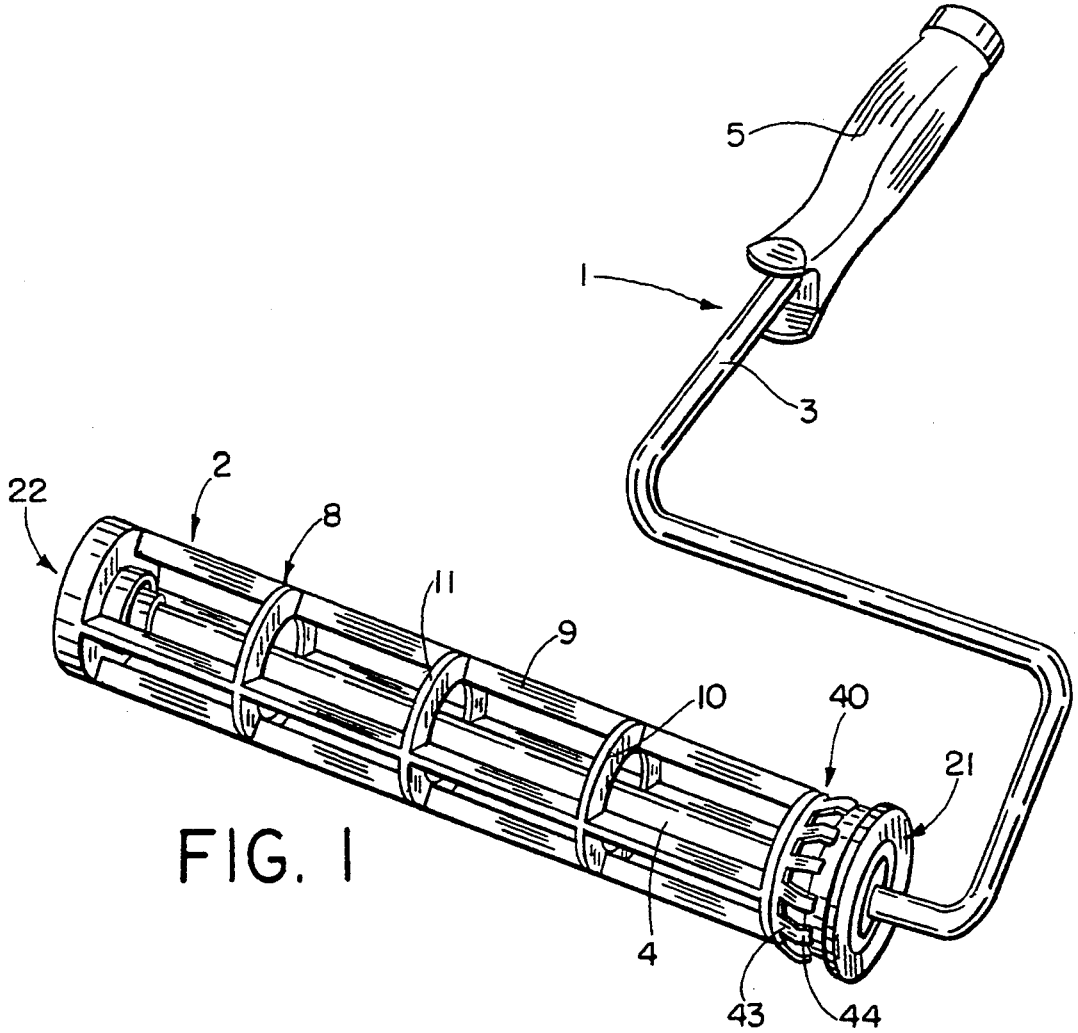
FIG. 1 is a perspective view of a preferred form of roller frame and cage assembly in accordance with this invention.
Figure 4:
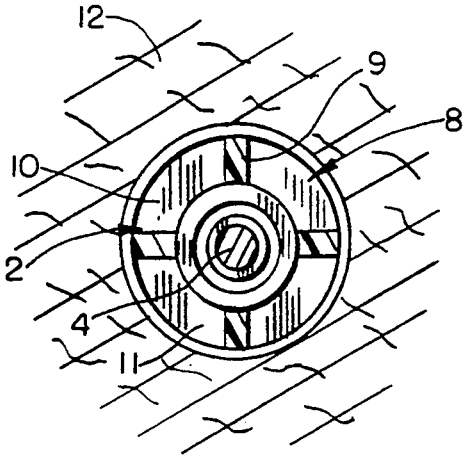
FIG. 4 is an enlarged transverse section through the roller frame and cage assembly of FIG. 3, taken generally along the plane of the line 4—4 thereof.
Figure 3:
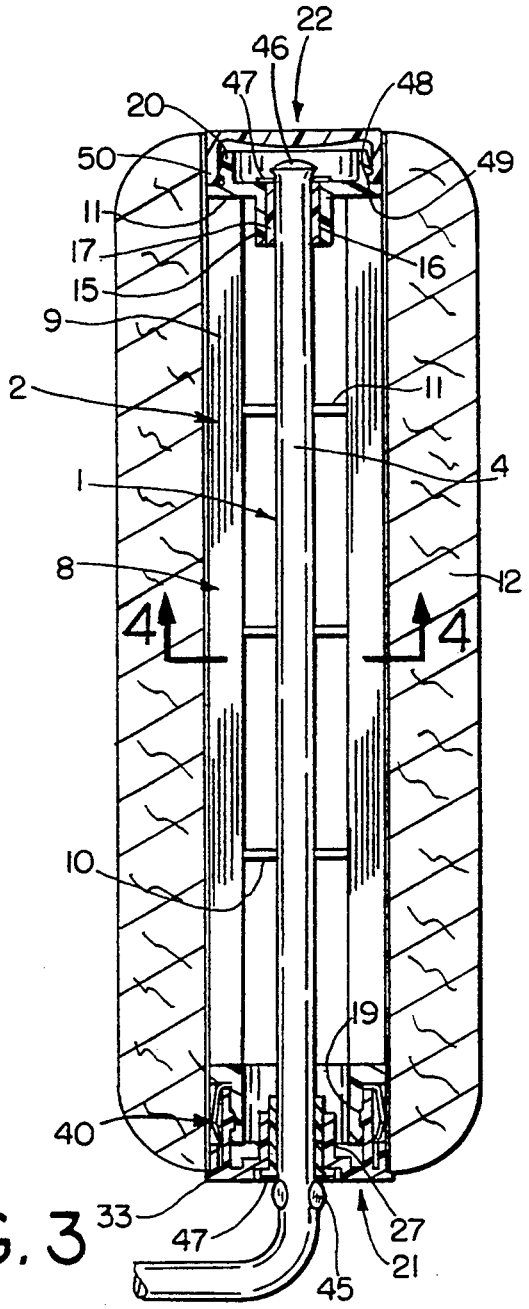
FIG. 3 is an enlarged fragmentary longitudinal section through the roller frame and cage assembly of FIG. 1 showing a roller cover securely fastened to the cage assembly by a retaining spring adjacent the inboard end of the cage assembly.

Referring now in detail to the drawings, and initially to FIGS. 1, 3 and 4, there is shown a preferred form of paint roller frame 1 and cage assembly 2 in accordance with this invention. The frame 1 is made from a heavy gauge wire or rod bent to shape to provide a handle portion 3 at one end and a shaft portion 4 at the other end for rotatably supporting the cage assembly 2 thereon. Attached to the handle portion 3 is a hand grip 5 (see FIG. 1) to facilitate grasping of the paint roller frame with one hand. A threaded socket (not shown) may be provided in the outer end of the hand grip 5 to permit attachment of an extension pole, if desired.

The cage assembly 2 includes a substantially rigid one piece cage body 8 preferably made of injection molded, fiberglass-filled nylon for increased strength and durability. The cage body 8 comprises a plurality of circumferentially spaced, longitudinally extending roller cover support bars 9 joined together at a plurality of axially spaced locations by arcuate ribs 10 extending between the bars. The support bars 9 are substantially straight and of uniform height over substantially their entire length as shown in FIGS. 1 and 4. Preferably the height of the ribs 10 substantially corresponds to the height of the bars 9, and where joined to the bars, form axially spaced annular rings 11 each having an outer diameter slightly less than the inner diameter of a paint roller cover 12 to be supported thereby.

Although the number and spacing of the support bars 9 and support rings 11 may vary, in the preferred embodiment disclosed herein, four such support bars are provided, each spaced approximately 90° apart. Also, such bars are connected together at their ends and at three uniformly spaced apart places intermediate their ends by the aforementioned rib-like members 10 which form five such support rings 11.

At the outboard end of the cage body 8 is an integrally molded central hub portion 15 having an axial opening 16 therethrough in which is press fitted a bushing 17 for rotatably receiving the shaft portion 4 (see FIG. 3). The cage body 8 is otherwise substantially open throughout its length except for a pair of relatively short annular flanges 19, 20 at opposite ends thereof on which closed end caps 21, 22 are mounted to prevent paint from getting inside the roller cover. Leaving the cage body 8 substantially open reduces the overall weight of the cage assembly 2 for reduced fatigue and makes it easy to clean when the roller cover 12 is removed therefrom.

Figure 5:
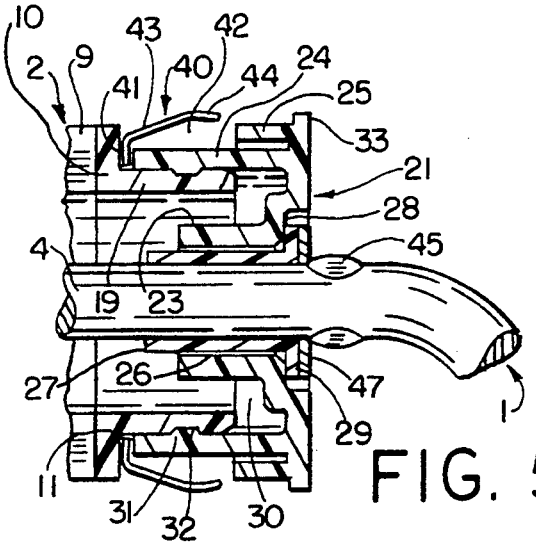
FIG. 5 is a further enlarged fragmentary longitudinal section through the inboard end of the roller frame and cage assembly of FIG. 3, but showing the Belleville type spring washer and associated fingers of the retaining spring in the relaxed position prior to insertion of a roller cover over the spring fingers.
Figure 6:
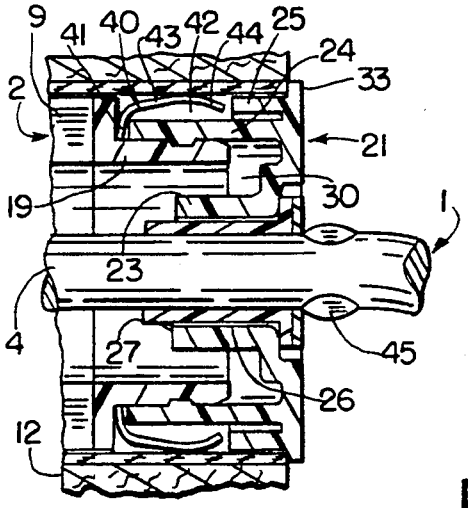
FIG. 6 is an enlarged fragmentary longitudinal section through the inboard end of the roller frame and cage assembly, similar to FIG. 5, but showing the Belleville type spring washer and associated fingers of the retaining spring in the tensioned position frictionally retaining a roller cover in place on the cage assembly.

The inboard end cap 21 includes three coaxially extending, radially spaced annular sleeve portions 23, 24 and 25 (see FIGS. 5 and 6). The radial innermost sleeve 23 includes an axial opening 26 therethrough in which an inboard bushing 27 may be press fitted also for rotatably receiving the shaft portion 4. Both bushings 17 and 27 may be made of silicon impregnated Delrin for reduced friction with the shaft 4. At the outer end of the inner sleeve 23 is a counterbore 28 for receipt of a flange 29 on the end of bushing 27.

The intermediate sleeve 24 is radially outwardly spaced from the inner sleeve 23 to provide an annular recess 30 therebetween for receipt of the annular flange 19 on the inboard end of the cage body 8. The inner diameter of flange 19 desirably forms a continuation of the annulus defined by the radial inner edges of the support bars 9 and interconnecting ribs 10. The outer diameter of flange 19, on the other hand, is less than the annulus defined by the radial outer edges of the bars 9 and interconnecting ribs 10 for telescoping receipt of the intermediate sleeve 24 over the flange 19 while still providing a radial clearance between the outer diameter of the intermediate sleeve 24 and annulus formed by the radial outer edges of the support bars 9 and interconnecting ribs 10 for a purpose to be subsequently described.

To secure the inboard end cap 21 to the cage body 8, an annular rib 31 is provided on the inner diameter of the intermediate sleeve 24 for snapping engagement into an annular groove 32 on the outer diameter of flange 19. When thus assembled, the outer diameter of the outer sleeve 25 substantially corresponds to the annulus defined by the radial outer edges of the support bars 9 and interconnecting ribs 10 to provide a continuation of such surface for supporting a roller cover 12 thereon. Extending radially outwardly beyond the inboardmost end of the outer sleeve 25 is an annular shoulder 33 which acts as a stop for locating the roller cover 12 on the cage assembly 2 when fully inserted thereon.

Figure 2:
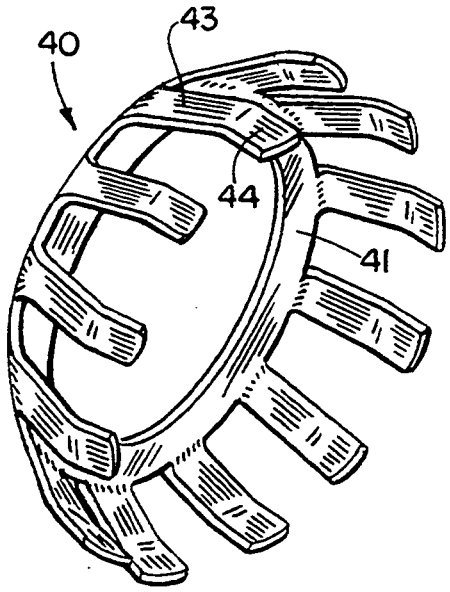
FIG. 2 is an enlarged perspective view of the retaining spring of FIG. 1 which is used to securely fasten a roller cover to the cage assembly.

To securely fasten the roller cover 12 to the cage assembly 2 while painting, a retaining spring 40 preferably made of cadmium-plated spring steel is mounted on the inboard end of the cage assembly. As best seen in FIGS. 2, 5 and 6, the retaining spring 40 includes a Belleville type spring washer portion 41 having an inner diameter slightly greater than the outer diameter of the inboard end flange 19 for sliding receipt thereon and trapping of the washer between the inboard ends of the support bars 9 and adjacent end of the intermediate sleeve 24. The outer diameter of the washer 41 is slightly less than the annulus formed by the radial outer edges of the support bars 9 and interconnecting ribs 10. Also, the axial length of the outer sleeve 25 is slightly less than that of the intermediate sleeve 24 to provide an annular recess 42 between the inboard ends of the support bars and adjacent end of the outer sleeve 25 for receipt of a plurality of circumferentially spaced fingers 43 extending radially and axially outwardly from the outer diameter of the washer 41 in the direction of the inboard end of the cage assembly.

When the retaining spring 40 is in the relaxed position shown in FIG. 5 with the roller cover 12 out of engagement with the fingers 43, the fingers extend radially outwardly beyond the normal range of inner diameter tolerances of roller covers to be used with the frame and cage assembly. For example, the normal range of tolerances of the inner diameters of the roller covers may be between approximately 1.47 inches and 1.5 inches, in which event the maximum outer diameter of the fingers 43 in the relaxed position may be on the order of 1.6 inches. Also, the fingers 43 gradually taper radially outwardly from the outer diameter of the washer 41 to the maximum diameter of the fingers 43 to facilitate wedging of the roller cover 12 over the fingers when the roller cover is pushed all the way up against the shoulder 33 on the inboard end cap 21 as shown in FIGS. 3 and 6. During axial movement of the roller cover 12 over the fingers 43, the fingers are tensioned radially inwardly into the annular space 42 between the inboard ends of the support bars 9 and adjacent end of the outer sleeve 25.

To permit the finger length to be as short as possible to minimize possible areas of entrapment of paint both under the fingers 43 and inside the inboard end cap 21 and still achieve the necessary overall deflection of the fingers to accommodate the normal range of tolerances of roller covers 12, the majority of the deflection of the fingers, for example, approximately 90% of such deflection, is desirably accommodated for by the deflection of the Belleville type spring washer portion 41 from the FIG. 5 position to the FIG. 6 position. Only a small portion of the total deflection of the fingers, for example, approximately 10%, is desirably accommodated for by the actual deflection of the fingers themselves.

In the preferred embodiment disclosed herein, the fingers 43 have an overall length of approximately 0.4 inch. Yet the total deflection of the fingers including the deflection resulting from the deflection of the spring washer portion 41 during insertion of the roller cover 12 over the fingers is approximately 0.06 inch.

When the fingers 43 are in the tensioned position shown in FIG. 6, the fingers preferably engage the inner diameter of the roller cover 12 over only approximately one-third of their length. Also, the outermost ends 44 of the fingers 43 taper slightly radially and axially inwardly away from the inner diameter of the roller cover 12 to prevent the ends of the fingers from digging into the roller cover during removal of the roller cover from the cage assembly. The total tension force exerted by the retaining spring 40 against the inner diameter of the roller cover is sufficient to securely fasten the roller cover to the cage assembly 2 while painting. Yet removal of the roller cover is easily accomplished with a single pull of the roller cover or a gentle tap of the roller frame 1 on the edge of a large sized paint can. Moreover, since the normal tolerance variations of the roller covers 12 used with the roller frame and cage assembly of the present invention are relatively small in comparison to the overall deflection of the fingers 43, the tension force exerted by the retaining spring 40 on such roller covers is substantially uniform.

The cage assembly 2 is retained against axial movement on the shaft 4 as by staking the shaft adjacent the inboard end of the cage assembly 2 at 45 and roll forming the outermost end 46 of the shaft after the cage assembly 2 has been inserted onto the shaft. Also, washers 47 may be inserted between the stakes 45 and roll formed end 46 of the shaft 4 and adjacent ends of the bushings 17, 27 to reduce friction.

After the cage assembly 2 has been assembled onto the shaft 4, the outboard end cap 22 is fitted over the outboard end of the cage body 8 as shown in FIG. 3 to prevent paint from getting inside the roller cover through such end. To secure the end cap 22 in place, an annular groove 48 may be provided in the outer diameter of the flange portion 20 for snapping receipt of an inturned lip 49-on the cylindrical wall 50 of the end cap. Also, the outer end of the flange 20 may be tapered radially inwardly toward its outermost end to facilitate wedging of the inturned lip 49 on the end cap 22 up over the flange 20 and into the groove 48. The outer diameter of the outboard end cap 22 substantially corresponds to the outer diameter of the annulus formed by the radial outer edges of the support bars 9 and interconnecting ribs 10 to provide a smooth uninterrupted surface for supporting the roller cover 12 on the cage assembly. Also, there is virtually no gap between the outboard ends of the support bars 9 and adjacent end of the outboard end cap 22 where paint could accumulate.

In the preferred embodiment disclosed herein, each support bar 9 is approximately 7.7 inches long., 0.1 inch thick, and 0.3 inch high. The flange portion 20 at the outboard end of the cage assembly 2 has an axial length of approximately 0.3 inch, and the surrounding end cap 22 has an overall length of approximately 0.5 inch. The flange portion 19 at the inboard end of the cage assembly has an axial length of approximately 0.5 inch and the surrounding end cap 21 has an overall length of approximately 0.8 inch. Also, the cage assembly 2 has an overall length from the outer end of the end cap 22 up to the shoulder 33 on the end cap 21 of approximately 9 to 9.1 inches to provide substantially uniform support for a 9 inch roller cover substantially throughout its entire length, preventing the roller cover from developing flat spots or becoming out of round during use. The annular recess 42 between the inboard ends of the support bars 9 and adjacent end of the outer sleeve 25 of the inboard end cap 21 in which the retaining spring fingers 43 are received has a length of approximately 0.4 to 0.5 inch.

Although the invention has been shown and described with respect to a certain preferred embodiment, it is obvious that equivalent alterations and modifications will occur to others skilled in the art upon the reading and understanding of the specification. The present invention includes all such equivalent alterations and modifications, and is limited only by the scope of the claims.

What is claimed is:

1. A paint roller frame and cage assembly, said frame comprising a handle portion and a shaft portion having an inner end connected to said handle portion and an outer end, said cage assembly being mounted for rotation on said shaft portion, said cage assembly including support means for uniformly supporting a roller cover thereon, said cage assembly having an inboard end adjacent said inner end of said shaft portion and an outboard end adjacent said outer end of said shaft portion, retaining spring means adjacent said inboard end of said cage assembly for frictionally retaining a roller cover on said support means, said retaining spring means including spring finger means engageable with an inner diameter of the roller cover for frictionally retaining the roller cover on said cage assembly, an annular flange at said inboard end of said cage assembly, said flange having an outer diameter less than the outer diameter of said support means, said retaining spring means being supported on said flange, and inboard end cap means attached to said cage assembly, said inboard end cap means including first annular sleeve means telescopingly received over said flange for trapping said retaining spring means on said flange.

2. The roller frame and cage assembly of claim 1 wherein said first sleeve means has a snap fit with said flange.

3. The roller frame and cage assembly of claim 1 wherein said inboard end cap means includes second annular sleeve means radially outwardly of said first sleeve means, said second sleeve means being shorter than said first sleeve means to provide an annular recess around said first sleeve means for receipt of said spring finger means.

4. The roller frame and cage assembly of claim 3 wherein the outer diameter of said second sleeve means is substantially the same as the outer diameter of said support means to provide a continuation of said support means for supporting the roller cover thereon.

5. The roller frame and cage assembly of claim 4 wherein said inboard end cap means has an annular shoulder extending radially outwardly beyond the outer diameter of said second sleeve means to provide a stop for locating the roller cover on said cage assembly when the roller cover is fully inserted thereon.

6. The roller frame and cage assembly of claim 3 wherein said inboard end cap means includes third annular sleeve means radially inwardly spaced from said first sleeve means to provide another annular recess into which said flange means extends.

7. The roller frame and cage assembly of claim 6 wherein said third sleeve means contains a bushing for rotatably supporting said inboard end of said cage assembly on said shaft portion.

8. A paint roller frame and cage assembly, said frame comprising a handle portion and a shaft portion having an inner end connected to said handle portion and an outer end, said cage assembly being mounted for rotation on said shaft portion, said cage assembly including support means for uniformly supporting a roller cover thereon, said cage assembly having an inboard end adjacent said inner end of said shaft portion and an outboard end adjacent said outer end of said shaft portion, and retaining spring means for frictionally retaining a roller cover on said support means, said retaining spring means comprising Belleville type spring washer means having spring finger means engageable with an inner diameter of a roller cover, said Belleville type spring washer means being deflectable upon engagement of the roller cover with said spring finger means to cause said spring finger means to move radially inwardly during sliding of the roller cover onto said support means front said outboard end.

9. The roller frame and cage assembly of claim 8 wherein said spring finger means are also deflectable radially inwardly independently of such movement of said spring finger means caused by such deflection of said Belleville type spring washer means upon engagement of said spring finger means by the roller cover.

10. The roller frame and cage assembly of claim 8 further comprising an annular flange at said inboard end of said cage assembly, said flange having an outer diameter less than the outer diameter of said support means, said Belleville spring washer means being supported on said flange.

11. The roller frame and cage assembly of claim 10 further comprising inboard end cap means attached to said flange for retaining said Belleville type spring washer means on said flange.

12. The roller frame and cage assembly of claim 11 wherein said inboard end cap means includes first annular sleeve means telescopingly received over said flange for trapping said Belleville type spring washer means on said flange.

13. The roller frame and cage assembly of claim 12 wherein said first sleeve means has a snap fit with said flange.

14. The roller frame and cage assembly of claim 10 wherein said Belleville type spring washer means has an outer diameter less than the outer diameter of said support means, and said spring finger means extend axially and radially outward from the outer diameter of said Belleville spring washer means.

15. The roller frame and cage assembly of claim 14 wherein said spring finger means extend in the direction of said inboard end of said cage assembly.

16. The roller frame and cage assembly of claim 15 wherein said spring finger means have an axial length of approximately 0.4 inch.

17. The roller frame and cage assembly of claim 15 wherein said spring finger means have outer ends which extend radially inwardly to prevent said ends from digging into the roller cover during removal of the roller cover from said cage assembly.

18. The roller frame and cage assembly of claim 8 wherein said support means includes a plurality of circumferentially spaced, axially extending support bars connected together by axially spaced rib means extending between said support bars, said support bars and said rib means having corresponding outer diameters whereby said rib means define with said support bars a plurality of axially spaced annular rings for uniformly supporting a roller cover thereon.

19. The roller frame and cage assembly of claim 18 further comprising inboard flange means extending axially from said support bars at said inboard end of said cage assembly, said retaining spring means being supported by said inboard flange means, and inboard end cap means having sleeve means disposed over said inboard flange means for retaining said retaining spring means on said inboard flange means.

20. The roller frame and cage assembly of claim 19 further comprising outboard flange means extending axially from said support bars at said inboard end of said cage assembly, and outboard end cap means inserted over said outboard flange means, said outboard end cap means having an outer diameter substantially corresponding to an annulus defined by said support bars and said rib means to provide a continuation of said support means for supporting a roller cover thereon.

21. The roller frame and cage assembly of claim 20 wherein said outboard end cap means has a snap fit with said outboard flange means.

22. The roller frame and cage assembly of claim 20 wherein said support bars, said rib means, and said flange means are integrally molded out of plastic.

23. The roller frame and cage assembly of claim 20 further comprising inboard and outboard bushing means for rotatably supporting said cage assembly on said shaft portion, said inboard bushing means being supported by said inboard end cap means, and said outboard bushing means being supported by a hub portion integrally molded with said support bars adjacent said outboard end of said cage assembly.

24. A paint roller frame and cage assembly, said frame comprising a handle portion and a shaft portion having an inner end connected to said handle portion and an outer end, said cage assembly being mounted for rotation on said shaft portion, said cage assembly having an inboard end adjacent said inner end of said shaft portion and an outboard end adjacent said outer end of said shaft portion, said cage assembly including a plurality of circumferentially spaced, axially extending support bars connected together by axially spaced rib means extending between said support bars, said support bars and said rib means having corresponding outer diameters whereby said rib means define with said support bars a plurality of axially spaced annular rings for uniformly supporting a roller cover thereon, retaining spring means for frictionally retaining a roller cover on said cage assembly, annular flange means extending axially from inboard ends of said support bars, said flange means having an outer diameter less than the outer diameter of said annular rings, said retaining spring means being supported by said flange means, end cap means having first annular sleeve means extending over said flange means for retaining said retaining spring means on said flange means, and second annular sleeve means having an outer diameter substantially corresponding to the outer diameter of said annular rings, said second annular sleeve means being axially spaced from said inboard ends of said support bars to provide an annular recess therebetween for receipt of said spring finger means, and an annular shoulder extending radially outward beyond the outer diameter of said annular sleeve means for locating a roller cover on said cage assembly when the roller cover is fully inserted thereon.

25. A paint roller frame and cage assembly, said frame comprising a handle portion and a shaft portion having an inner end connected to said handle portion and an outer end, said cage assembly being mounted for rotation on said shaft portion, said cage assembly having an inboard end adjacent said inner end of said shaft portion and an outboard end adjacent said outer end of said shaft portion, said cage assembly including a plurality of circumferentially spaced, axially extending support bars connected together by axially spaced rib means extending between said support bars, said support bars being substantially straight and of uniform height over substantially the entire length of said support bars, said support bars and said rib means having corresponding outer diameters whereby said rib means define with said support bars a plurality of axially spaced annular rings for uniformly supporting a roller cover thereon, retaining spring means for frictionally retaining a roller cover on said cage assembly, and an annular flange at said inboard end of such cage assembly having an outer diameter less than the outer diameters of said support bars and said rib means, said retaining spring means being supported on said flange.

* * * * *